United States Patent [19]

Sato

[11] 4,290,372

[45] Sep. 22, 1981

[54] FURNACE DOOR HAVING SEALING STRUCTURE FOR SEALING BETWEEN FURNACE DOOR AND FURNACE FRAME

[75] Inventor: Shitomi Sato, Sakai, Japan

[73] Assignee: Kubota, Ltd., Osaka, Japan

[21] Appl. No.: 67,644

[22] Filed: Aug. 17, 1979

[30] Foreign Application Priority Data

| | | | |
|---|---|---|---|
| Aug. 21, 1978 | [JP] | Japan | 53/101983 |
| Aug. 21, 1978 | [JP] | Japan | 53/114917[U] |
| Sep. 18, 1978 | [JP] | Japan | 53/114965 |
| Jan. 30, 1979 | [JP] | Japan | 54/11725[U] |

[51] Int. Cl.[3] ..... F23M 7/00

[52] U.S. Cl. ..... 110/173 R; 202/248

[58] Field of Search ..... 110/173 R, 173 A; 202/248, 269, 242, 247; 126/190; 122/498; 49/484

[56] References Cited

U.S. PATENT DOCUMENTS

| | | | |
|---|---|---|---|
| 4,002,537 | 1/1977 | Calderon | 110/173 R X |
| 4,016,046 | 4/1977 | Ackeren et al. | 110/173 R X |
| 4,115,203 | 9/1978 | Naevestad | 110/173 R X |
| 4,200,499 | 4/1980 | Gerding | 110/173 R X |

*Primary Examiner*—Edward G. Favors

*Attorney, Agent, or Firm*—Edwin E. Greigg

[57] ABSTRACT

A door having a sealing structure for sealing space between the door and frame of a furnace, which may be used for various types of furnace such as coke ovens. The sealing structure comprises pressing means and sealing means. A slip plate is provided between the door surface and a spring leaf constituting the sealing means. The slip plate, the spring leaf and the pressing means are adapted to slide integrally to cause a knife edge attached to a free side of the spring leaf to abut against the furnace frame.

23 Claims, 12 Drawing Figures

2
3
3
(3a)
8
8a
8b
8c
11
12
12a
13
13b
16
17
22
22a
24
25
26
27
28
29
30
31
32
46

FURNACE DOOR HAVING SEALING STRUCTURE FOR SEALING BETWEEN FURNACE DOOR AND FURNACE FRAME

BACKGROUND OF THE INVENTION

This invention relates to doors having sealing structures for sealing space between the doors and frames of various furnaces such as coke ovens.

A conventional furnace door having such a sealing structure is illustrated in FIG. 11 of the accompanying drawings.

Referring to FIG. 11, sealing means 11 of the type comprising a spring leaf 12 and a knife edge 13 uses the elasticity of the spring leaf 12 to make the sharp side of the knife edge 13 abut against a furnace frame 2. This has the advantage that the sharp side of the knife edge 13 is capable of following the furnace frame 2 despite unevenness of the frame 2 and a deformation by heat of the door 3. The disadvantage of this conventional arrangement is that, since the spring leaf 12 is directly supported by and between the furnace door 3 and pressing means 22, the spring leaf 12 is made to slide relative to the door 3 when the pressing means 22 is pressed by a pressing bolt 46 to cause the knife edge 13 to move toward the furnace frame 2. Particularly, the spring leaf 12 is formed of relatively thin material for a good amount of deformation, and is liable to go out of shape or get damaged due to the unevenness of the furnace door 3 as it slides in direct contact with the furnace door 3, which will result in gas leaks by space between the furnace door 3 and the spring leaf 12.

SUMMARY OF THE INVENTION

The present invention intends to solve the problem of the conventional furnace door as described above.

To this end, a sealing structure for sealing space between a furnace door and a furnace frame according to this invention comprises pressing means attached to the furnace door movably toward and away from the furnace frame, sealing means disposed between the pressing means and the furnace door and adapted to move with movement of the pressing means and to abut against the furnace frame, and is characterized in that the sealing means on at least two opposite sides of the furnace door respectively comprise a spring leaf and a knife edge attached to a free side of the spring leaf, and a slip plate is provided between the furnace door and the spring leaf as well as the pressing mens, the slip plate being adapted to slide with a movement of the pressing means toward the furnace frame to thereby cause the knife edge by way of the spring leaf to abut against the furnace frame.

In the above arrangement, since the spring leaf constituting sealing means is integrally slidably supported by and between the pressing means and the slip plate, there is no frictional sliding of the spring leaf over the furnace door surface.

This feature prevents damage to the spring leaf though the spring leaf is formed of relatively thin material, and assures good sealing performance.

The primary object of this invention is to provide an economical sealing structure capable of sealing space between a furnace door and a furnace frame in a reliable manner.

Another object of this invention is to provide a sealing structure that can be applied to existing furnace doors relatively easily.

Other objects and advantages of this invention will be apparent from the following description.

DETAILED DESCRIPTION OF THE PREFERRED EMBODIMENTS

Figure 1:
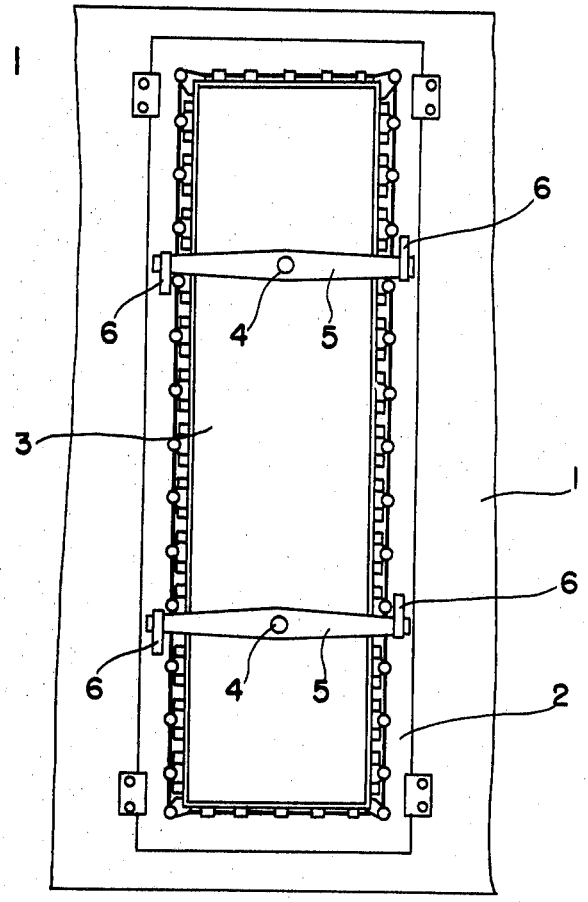
FIG. 1 is a front view of a furnace door with a sealing structure according to this invention secured tight to a furnace frame.
Figure 2:
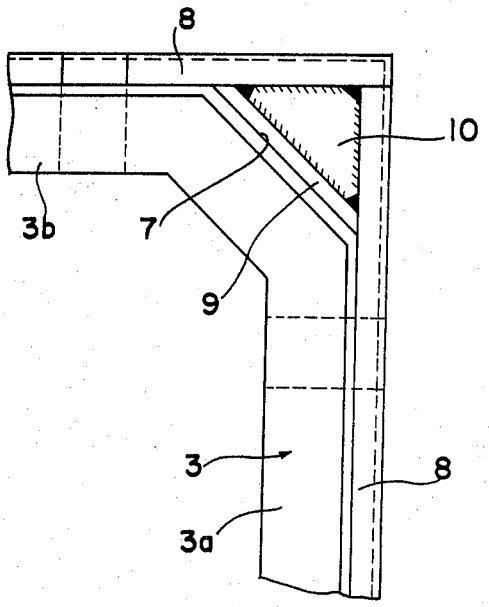
FIG. 2 is a front view of a corner of the furnace door showing how slip plates are attached.

FIG. 1 is a front view of a rectangular door 3 attached to a frame 2 mounted on the periphery of an opening of a coke oven 1. The door 3 is pressed to the frame 2 and held in position by a pair of upper and lower bars 5 oscillatably attached to the door 3 on pivots 4 and in engagement with metal hooks 6 on the frame 2. The door 3 has a notched surface 7 at each of the four corners, as shown in FIG. 2, and slip plates 8 jointly forming a rectangle and fitted on the outer periphery of the door 3. Space between the notched surface 7 and the slip plates 8 is sealed airtight by a triangular sealing plate 10 welded to the slip plates 8 and to a plate member 9 in contact with the notched surface 7. The long sides **3*a* of the door 3 are provided with a sealing structure of the type comprising sealing means 11 including a spring leaf 12 and a knife edge 13, while the short sides 3*b* of the door 3 are provided with a sealing structure of the type comprising a knife edge 13 alone, which will be described in detail below. The four corners of the door 3 where the two types of sealing structure meet are as shown in FIG. 3**.

Figure 3:
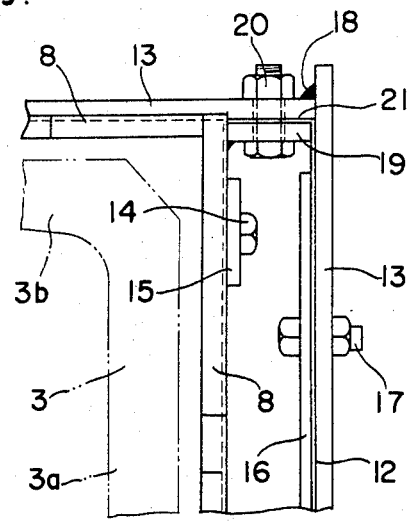
FIG. 3 is a front view of a corner of the furnace door showing how knife edges are attached.

Referring to FIG. 3, spring leaf 12 is made of stainless steel and has a U-shaped cross section, one of the opposing sides thereof being secured to slip plate 8 and the other to knife edge 13. The spring leaf 12 and the slip plate 8 are secured to one another by means of bolts 14 disposed at suitable intervals of space along the spring leaf 12 and the slip plate 8. Numeral 15 denotes washers. The spring leaf 12 and the knife edge 13 are secured to one another together with a lining board 16 by means of bolts and nuts 17 disposed at suitable intervals in the longitudinal direction thereof. The knife edge 13 on the long side **3*a* and the knife edge 13 on the short side 3*b* are welded together at their ends. The two ends of the spring leaf 12 are sealed by end plates 19 welded to the spring leaf 12. An end of the knife edge 13 on the short side 3*b* is located on an outer surface of the spring leaf 12, which is secured tight to the end plate 19 with a packing 21 in between by means of a bolt and nut 20** extending through bolt holes defined thereon.

FIGS. 4 to 7 show details of the sealing structure on either long sides 3*a* of the furnace door 3, in which numerals 22*a* and 22*b* indicate rectangular plate members that act as pressing means. The two rectangular plate members 22*a* and 22*b* are integrally interconnected by a connecting plate member 23, and have a tapered shape thickening toward the furnace door 3. Each of the rectangular plate members 22*a* and 22*b* includes a central elongate opening 24 defined in the longitudinal direction thereof and ribs 25 along the two sides of the elongate opening 24. The ribs 25 extend from the thin ends of the rectangular plate members 22*a* and 22*b* to the middle portions longitudinally thereof and have ends abutting against the side 8*a* of the slip plate 8 not facing the furnace frame 2. Numeral 26 indicates supporting plates contacting side faces of the rectangular plate members 22*a* and 22*b*, which supporting plates 26 each have a tapered shape thickening in the direction in which the rectangular plate members 22*a* and 22*b* get thinner, and include an opening 27 defined in the center. The openings 27 of the supporting plates 26 and the elongate openings 24 of the rectangular plate members 22*a* and 22*b* are penetrated by bolts 30 that also penetrate mounting openings 28 defined on a lateral wall of the furnace door 3 and cutouts 29 of the slip plate 8. Each of the bolts 30 carries a spring washer 31 and a nut 32. The slip plate 8, the rectangular plate members 22*a* and 22*b* and supporting plates 26 are secured integral with the furnace door 3 by tightening the nuts 32. The connecting plate member 23 has a protrusion 33 including a threaded opening which meshingly receives an end of a tubular support frame 35 constituting spring means 34. This support frame 35 contains a slidable press rod 36 to abut against the back 13*a* of the knife edge 13. The support frame 35 further contains a resilient element 37 which has one end engaging a collar 36*a* of the press rod 36 and biases the press rod 36 toward the knife edge 13. The resilient element 37 comprises a coil spring, and the other end thereof engages with a hollow adjustor screw 38 which meshes with the support frame 35. Numeral 39 indicates a ring shaped stopper securely fixed inside the support frame 35 and in engagement with the collar 36*a* of the press rod 36. Numeral 40 indicates a lock nut fitted about the support frame 35, and numeral 8*c* indicates an engaging portion defined over the entire length of a side surface of the slip plate 8 to engage a side edge of the spring leaf 12.

Figure 8:
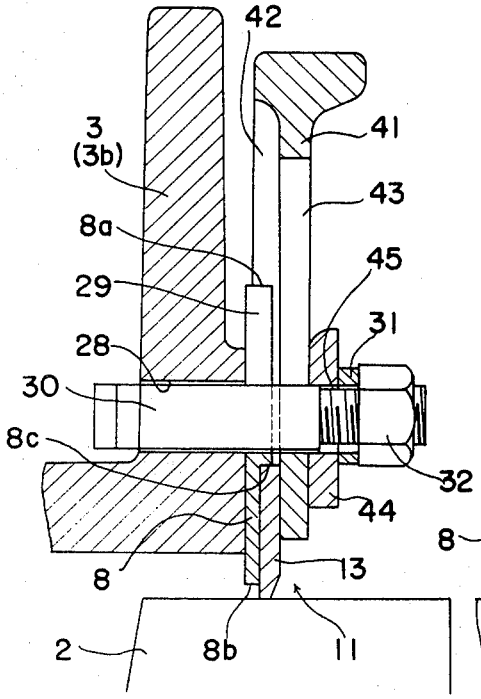
FIG. 8 is a side view in vertical section of a sealing structure on a short side of the furnace door.
Figure 9:
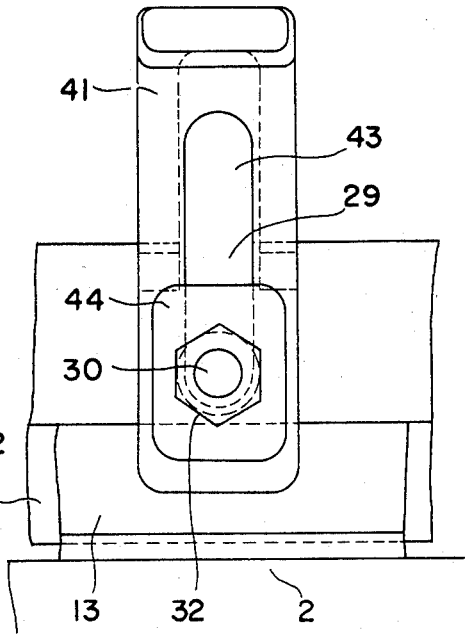
FIG. 9 is a plan view of the sealing structure of FIG. 8.
Figure 4:
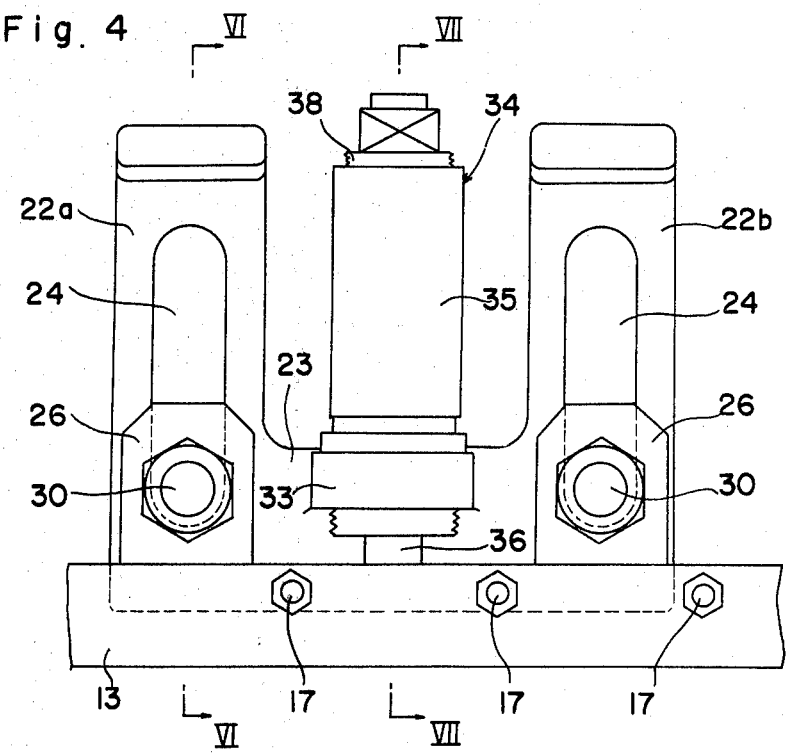
FIG. 4 is a front view of a sealing structure on a long side of the furnace door.
Figure 5:
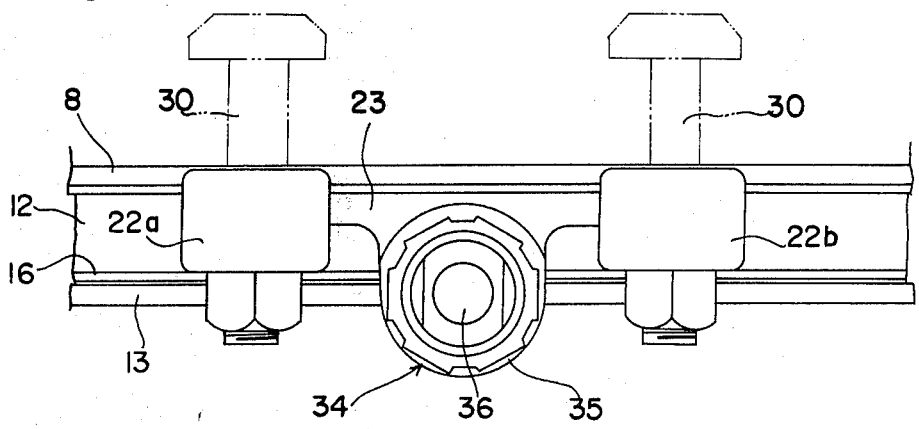
FIG. 5 is a plan view of the sealing structure of FIG. 4.
Figure 6:
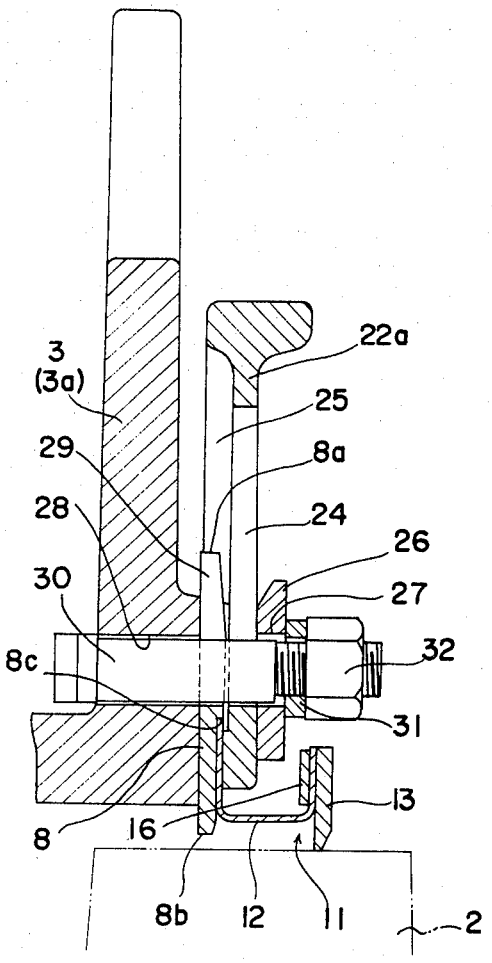
FIG. 6 is a section on line VI—VI of FIG. 4.
Figure 7:
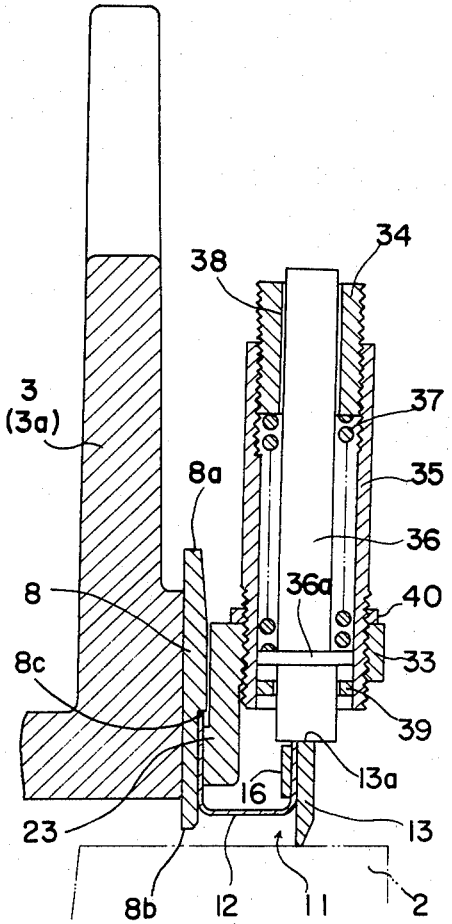
FIG. 7 is a section on line VII—VII of FIG. 4.

Referring to FIGS. 8 and 9 which show details of a sealing structure on either short sides 3*b* of the furnace door 3, the side of the knife edge 13 not facing the furnace frame 2 is in engagement with an engaging portion 8*c* defined over the entire length of a side surface of the slip plate 8. The side 8*b* of the slip plate 8 facing the furnace frame 2 protrudes slightly from the side surface of the furnace door 3, and the side of the knife edge 13 facing the furnace frame 2 protrudes further from the slip plate 8 and abuts against the furnace frame 2. Numeral 41 indicates a plate member that acts as pressing means. The plate member 41 has a tapered shape thickening toward one longitudinal end thereof which constitutes and abutting portion in contact with the side face of the knife edge 13 adjacent the end thereof not facing the furnace frame 2. The plate member 41 is provided with ribs 42 on its back surface and extending from the thin end to the longitudinal middle thereof. The ribs 42 have ends abutting against the side 8*a* of the slip plate 8 not facing the furnace frame 2. The plate member 41 includes a central elongate opening 43 defined in the longitudinal direction thereof. Numeral 44 indicates a supporting plate contacting the plate member 41, and having a tapered shape thickening in the direction in which the plate member 41 gets thinner. The supporting plate 44 includes a central opening 45. The opening 45 of the supporting plate 44 and the elongate opening 43 of the plate member 41 are penetrated by a bolt 30 which also penetrates a mounting opening 28 defined on a side wall of the furnace door 3 and a cutout 29 of the slip plate 8. The bolt 30 carries a spring washer 31 and a nut 32 at a tip end thereof, and the slip plate 8, the knife edge 13, the plate member 41 and the supporting plate 44 are secured integral with the furnace door 3 by tightening the nut 32.

Figures 10, 11, 12:
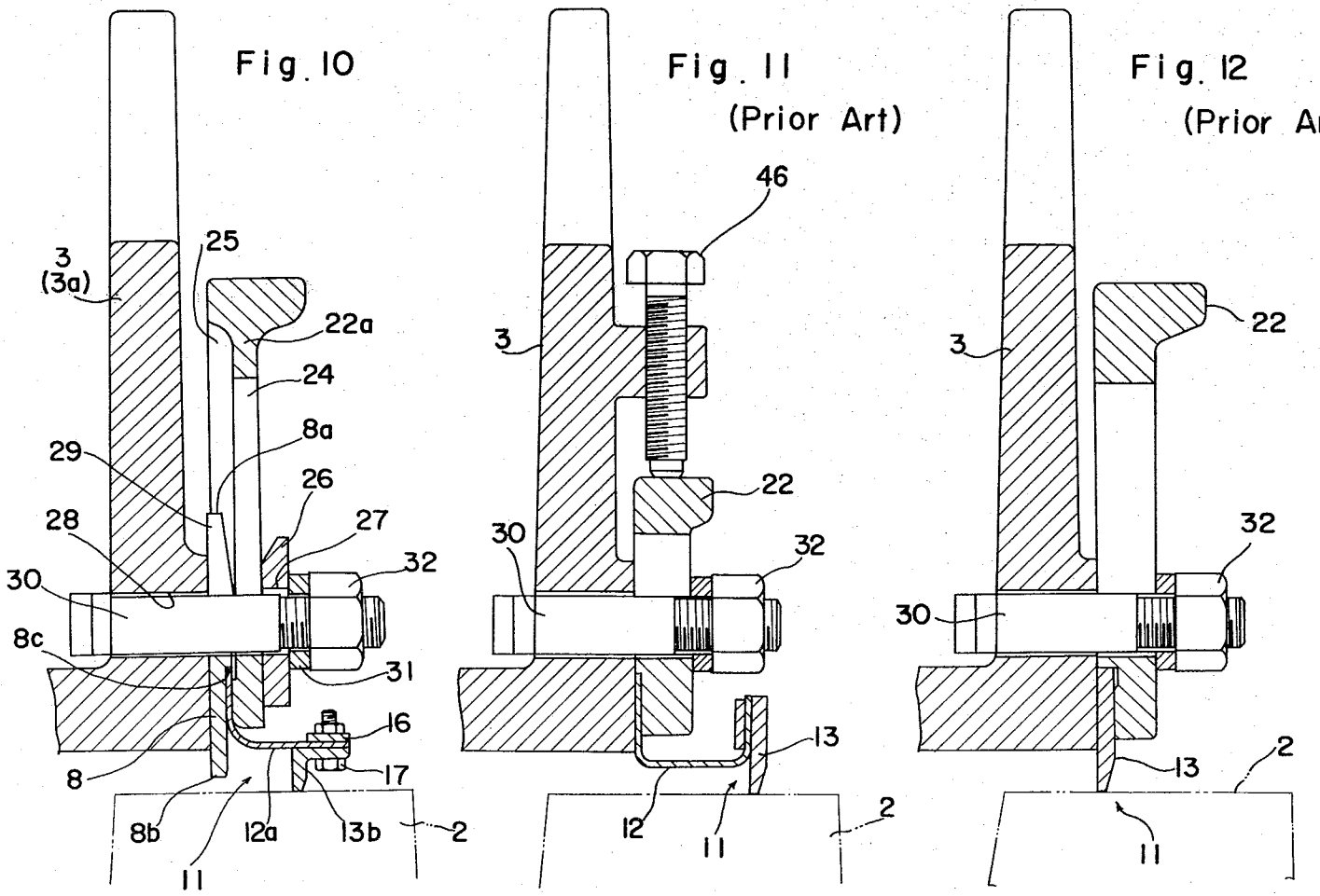
Fig. 12 (Prior Art)
Fig. 11 (Prior Art)
FIG. 10 is a side view in vertical section of a modified sealing structure on a long side of the furnace door.
FIGS. 11 and 12 are side views in vertical section each showing a known sealing structure.

How the foregoing sealing arrangement operates will be described now. The knife edge 13 on the short side 3*b* of the furnace door 3 is made, together with the slip plate 8, to protrude toward the furnace frame 2 by striking a head portion of the plate member 41 with a hammer or the like. Once struck out, the knife edge 13 cannot return easily because the slip plate 8 has a tapered shape and is held tight, together with the supporting plate 44, by the bolt 30. Furthermore, the provision of the slip plate 8 produces the following effect. In the conventional type of sealing structure where sealing means 11 comprises the knife edge 13 alone, as shown in FIG. 12, the knife edge 13 is directly supported by and between the furnace door 3 and pressing means 22. Because the knife edge 13 is formed of special steel, it does not fit intimately with the surface of the furnace door 3, which results in gas leakage. A known solution to this problem provides the knife edge 13 with a large width to realize a large are of contact between the knife edge 13 and the furnace door 3. However, this requires the knife edge 13 with cutouts or the like to receive bolts 30 since there is a restriction to the mounting position of bolts 30 and nuts 32 for mounting pressing means 22 and the like on the furnace door 3. Because the knife edge 13 is made of special steel, the cutting out operation takes much trouble and high cost. In contrast, the provision of slip plate 8 according to the present invention provides good intimacy between the slip plate 8 and the surface of the furnace door 3 and between the slip plate 8 and the knife edge 13 by treating the two surfaces of the slip plate 8 which is relatively easy to treat. Furthermore, the present invention provides a large area of contact between the slip plate 8 and the knife edge 13 without any treatment or shaping of the knife edge 13, by protruding the slip plate 8 from a side of the furnace door 3 toward the furnace frame 2.

The knife edge 13 on the long side 3*a* of the furnace door 3 is pressed by the resilient element 37 through press rod 36 of the spring means 34 and by the elasticity of the spring leaf 12 against the furnace frame 2. Therefore, a close contact is always maintained between the knife edge 13 and the furnace frame 2 even if a little deformation occurs to the furnace door 3 or the furnace frame 2 during operation of the furnace or coke oven 1. When the furnace door 3 deforms considerably causing gas leakage, the knife edge 13 is made to protrude out by striking heads of the rectangular plate members 22*a* and 22*b*. In other words, by striking the rectangular plate members 22*a* and 22*b*, the knife edge 13, together with the slip plate 8, is forced out toward the furnace frame 2. At this time, the relative position between the knife edge 13 and the support frame 35 remains unchanged in spite of the striking out of the knife edge 13 because the support frame 35 supporting the press rod 36 is mounted on the connecting plate member 23 coupled to the two rectangular plate members 22*a* and 22*b*. Therefore, the knife edge 13 is pressed against the furnace frame 2 under a constant force all the time, without marked variations in the pressing force accompanying the positional change of the knife edge 13 that are observed in many conventional types of sealing structure. Furthermore, since the rectangular plate members 22*a* and 22*b* are disposed adjacently on either sides of the support frame 35, the relative position between the knife edge 13 and support frame 35 hardly changes and variations in the pressing force due to a twisting of the resilient element 37 will not occur, whether the heads of the two rectangular plate members 22*a* and 22*b* are struck simultaneously or alternately to force out the knife edge 13. This feature assures reliable sealing. The pressing force is adjustable by means of the adjustor screw 38. It is to be noted that the spring leaf 12 is brittle and care should be taken to avoid an excessive deformation thereof at the time of striking out. The invention prevents such an excessive deformation of the spring leaf 12 by arranging that the slip plate 8 has the side 8*b* facing the furnace frame 2 in a position further protruded than the spring leaf 12, as illustrated in the drawings. This slip plate 8 acts as stopper when the degree of striking reaches an excess. When the door 3 is removed from the furnace or coke oven 1, freeing the knife edge 13, an excessive pressing force of the resilient element 37 against the knife edge 13 is prevented by engagement of the collar 36*a* of the press rod 36 with the stopper 39.

The sum total of the forces of resilient elements of all the spring means 34 pressing the knife edges 13 on the long sides 3*a* of the furnace door 3 is conveniently adjusted to 20 to 40% of the pressing force of the bars 5 which press the whole door 3. Then, 40 to 60% of the pressing force of the bars 5 acts on the knife edges 13 on the short sides 3*b* of the furnace door 3 which have no resilient element. Thus, while the knife edges 13 on the short sides 3*b* of the door 3 are pressed hard against the frame 2 to provide a sufficiently airtight condition, the sealing means 11 with the spring leaves 12 provided on the long sides 3*a* of the furnace door 3 serve to allow for deformations by heat of the furnace frame 2 and the furnace door 3 that occur during normal operation. Owing to this feature, it is sufficient to carry out striking out of the knife edges on both the long sides 3*a* and short sides 3*b* of the door 3 at the time of mounting the door 3 on to the furnace 1, and the dangerous striking operation during the running of the furnace is reduced to a minimum. The reduction of the striking operation reduces damage to sealing surfaces and the knife edges 13 and improves durability.

As described above, a good sealing effect is produced by the very simple structure. It should be particularly noted that the sealing means 11 on the short sides 3*b* comprising the knife edges 13 alone and the sealing means 11 on the long sides 3*a* comprising the spring means 12 and the knife edges 13 are invariably attachable only by providing mounting openings on the furnace door 3 for receiving bolts 30. This means that the structure of this invention can be readily employed on existing furnaces and has a great utility. In addition, the feature of providing the short sides 3*b* of the door 3 with the sealing means 11 comprising the knife edges 13 alone and the long sides 3*a* with the sealing means 11 comprising the spring leaves 12 and the knife edges 13 has the following notable advantages.

When the door 3 deforms by heat, the door 3 deforms greatly in the longitudinal direction resulting in geater gaps between the door 3 and the furnace frame 2 along the short sides 3*b* than along the long sides 3*a*. Therefore, it is necessary to provide also the short sides 3*b* of the door 3 with the sealing means 11 comprising the spring leaves 12 and the knife edges 13 and to use spring leaves 12 of large width. However, in existing furnace door 3 and furnace frame 2, the short sides 3*b* of the door 3 are spaced from the frame 2 by only a little, allowing no sufficient space for the knife edges 13 of large width. Therefore the knife edges 13 on existing furnace doors 3 cannot be replaced with structures in which the knife edges 13 are supported by the spring leaves 12. By contrast, if the sealing means 11 comprising the knife edge 13 alone is used for the short sides 3*b* of the door 3 as in this invention, the door 3 can be mounted onto an existing furnace 1 with ease. By fixing the furnace door 3 securely by means of the pair of upper and lower bars 5 adjacent the short sides 3*b*, a heat deformation shows on the long sides 3*a* of the door 3, which is absorbed by the spring leaves 12 provided on the long sides 3*a*, and thus a reliable sealing is secured. The short sides 3*b* of the door 3 provided with no spring leaves 12 has the advantage of facilitating positional adjustment of the door 3 relative to the furnace frame 2 when fixing the door 3 tight on the frame 2.

By arranging the fixing structures for the knife edges 13 and the spring leaves 12 of the two sides 3*a* and 3*b* of the furnace door 3 at the four corners as shown in FIG. 3 and described in the foregoing part of this specification, the necessary replacement of knife edges 13 every few years may be carried out simply by welding as at 18 at the four corners and by removing and mounting the bolts and nuts 17 for mounting the knife edges. Since most of the component elements such as the knife edges 13 and the spring leaves 12 are held in position by means of bolts and nuts, there occurs no deformation due to welding and the structure is without much restraint. This facilitates deformation of the spring leaves 12 and good airtight condition by means of the knife edges 13. Furthermore, the dominant use of bolts and nuts for tightening purposes makes possible handling of the component elements independently to facilitate maintenance.

FIG. 10 shows a modified form of the sealing means 11 on the long sides 3*a* of the furnace door 3, in which a knife edge 13*b* attached to a free side of a spring leaf 12*a* has an L-shaped cross section. The other components are the same as those already described and are indicated by like reference numerals, and explanation thereof is omitted. By providing the knife edge 13*b* of L-shaped cross section as in this modification, a contact position of the sharp side of the knife edge 13*b* with the furnace frame 2 may be close to the door 3 even if the spring leaf 12*a* is provided with a large width to improve the followability of the knife edge 13*b* relative to the frame 2. In spite of its large width, the area of the spring leaf 12*a* exposed to hot gas can be kept small to prevent damage to the spring leaf 12*a* by hot gas and assure a good sealing performance over a long period of time.

It should be understood that this invention is not limited to the structures described in the foregoing. The invention may be worked in many varied forms. For example, while the spring leaf 12 shown in FIGS. 6 and 7 has a U-shaped cross section and the spring leaf 12*a* shown in FIG. 10 has an L-shaped cross section, these spring leaves 12, 12*a* may have a cross section with complicated winding to further improve the followability of the knife edge 13 relative to the furnace frame 2.

I claim:

1. A furnace door having a sealing structure for sealing space between the furnace door and a furnace frame, said sealing structure comprising, pressing means attached to said furnace door movably toward and away from said furnace frame, sealing means disposed between said pressing means and said furnace door and adapted to move with movement of said pressing means and to abut against said furnace frame, characterized in that said sealing means (11) on at least two opposite sides (3*a*, 3*a*) of said furnace door (3) respectively comprise a spring leaf (12) and a knife edge (13, 13*b*) attached to a free side of said spring leaf (12), and a slip plate (8) provided between said furnace door (3) and said spring leaf (12) and between said pressing means (22*a*, 22*b*) and said furnace frame, said slip plate (8) being adapted to slide with a movement of said pressing means (22*a*, 22*b*) toward said furnace frame (2) to thereby cause said knife edge (13, 13*b*) by way of said spring leaf (12) to abut against said furnace frame (2).

2. A furnace door as claimed in claim 1 characterized in that said pressing means (22*a*, 22*b*) has a step portion to abut against a side (8*a*) of said slip plate (8) not facing said furnace frame (2), and said slip plate (8) has an engaging portion (8*c*) to engage a side of said spring leaf (12).

3. A furnace door as claimed in claim 1 or 2 characterized in that said pressing means (22*a*, 22*b*) is arranged in pairs, each pair interconnected by a connecting plate portion (23) provided with spring means (34) to press the back (13*a*) of said knife edge (13, 13*b*).

4. A furnace door as claimed in any one of claims 1 or 2 characterized in that said knife edge (13*b*) has an L-shaped cross section.

5. A furnace door as claimed in claim 1 characterized in that said two opposite sides of said furnace door (3) are the long sides of said furnace door (3).

6. A furnace door as claimed in claim 5 characterized in that said sealing means (11) on opposite short sides (3*b*, 3*b*) of said furnace door (3) comprises said knife edge (13) alone, and said slip plate (8) is provided between said furnace door (3) and said pressing means (41) as well as said knife edge (13), said slip plate (8) being adapted to slide with a movement of said pressing means (41) toward said furnace frame (2) to thereby cause said knife edge (13) to abut against said furnace frame (2).

7. A furnace door as claimed in claim 6 characterized in that said pressing means (41) has a step portion to abut against a side (8*a*) of said slip plate (8) not facing said furnace frame (2), and said slip plate (8) has an engaging portion (8*c*) to engage a side of said knife edge (13).

8. A furnace door as claimed in claim 7 characterized in that said pressing means (22*a*, 22*b*, 41) and said slip plate (8) are attached integral with said furnace door (3) by bolts (30) and nuts (32).

9. A furnace door as claimed in claim 7 characterized in that said pressing means (22*a*, 22*b*, 41) is tapered in a longitudinal direction thereof and supporting plates (26, 44) disposed between said pressing means (22*a*, 22*b*, 41) and said nuts (32) are tapered in the direction opposite said longitudinal direction.

10. A furnace door as claimed in claim 1, characterized in that said pressing means is arranged in pairs, each pair interconnected by a connecting plate portion provided with spring means to press the back of said knife edge, and wherein said knife edge has an L-shaped cross section.

11. A furnace door as claimed in claim 2, characterized in that said pressing means is arranged in pairs, each pair interconnected by a connecting plate portion provided with spring means to press the back of said knife edge, and wherein said knife edge has an L-shaped cross section.

12. A furnace door as claimed in claim 2, characterized in that said two opposite sides of said furnace door are the long sides of said furnace door.

13. A furnace door as claimed in claim 1, characterized in that said pressing means is arranged in pairs, each pair interconnected by a connecting plate portion provided with spring means to press the back of said knife edge, and wherein said two opposite sides of said furnace door are the long sides of said furnace door.

14. A furnace door as claimed in claim 10, characterized in that said two opposite sides of said furnace door are the long sides of said furnace door.

15. A furnace door as claimed in claim 12, characterized in that said sealing means on opposite short sides of said furnace door comprises said knife edge alone, and said slip plate is provided between said furnace door and said pressing means as well as said knife edge, said slip plate being adapted to slide with a movement of said pressing means toward said furnace frame to thereby cause said knife edge to abut against said furnace frame.

16. A furnace door as claimed in claim 13, characterized in that said sealing means on opposite short sides of said furnace door comprises said knife edge alone, and said slip plate is provided between said furnace door and said pressing means as well as said knife edge, said slip plate being adapted to slide with a movement of said pressing means toward said furnace frame to thereby cause said knife edge to abut against said furnace frame.

17. A furnace door as claimed in claim 14, characterized in that said sealing means on opposite short sides of said furnace door comprises said knife edge alone, and said slip plate is provided between said furnace door and said pressing means as well as said knife edge, said slip plate being adapted to slide with a movement of said pressing means toward said furnace frame to thereby cause said knife edge to abut against said furnace frame.

18. A furnace door as claimed in claim 16, characterized in that said pressing means has a step portion to abut against a side of said slip plate not facing said furnace frame, and said slip plate has an engaging portion to engage a side of said knife edge.

19. A furnace door as claimed in claim 17, characterized in that said pressing means has a step portion to abut against a side of said slip plate not facing said furnace frame, and said slip plate has an engaging portion to engage a side of said knife edge.

20. A furnace door as claimed in claim 16, characterized in that said pressing means and said slip plate are attached integral with said furnace door by bolts and nuts.

21. A furnace door as claimed in claim 17, characterized in that said pressing means and said slip plate are attached integral with said furnace door by bolts and nuts.

22. A furnace door as claimed in claim 16, characterized in that said pressing means is tapered in a longitudinal direction thereof and supporting plates disposed between said pressing means and said nuts are tapered in the direction opposite said longitudinal direction.

23. A furnace door as claimed in claim 17, characterized in that said pressing means is tapered in a longitudinal direction thereof and supporting plates disposed between said pressing means and said nuts are tapered in the direction opposite said longitudinal direction.

* * * * *